United States Patent [19]

Reed

[11] 4,037,344

[45] July 26, 1977

[54] MAGNETIC CARTRIDGE CHAMBERING AND BOLT HOLDING SYSTEM

[75] Inventor: Frederick P. Reed, Davenport, Iowa

[73] Assignee: The United States of America as represented by the Secretary of the Army, Washington, D.C.

[21] Appl. No.: 669,061

[22] Filed: Mar. 22, 1976

[51] Int. Cl.[2] ..... F41C 13/00

[52] U.S. Cl. ..... 42/16; 42/1 MH; 89/35 R

[58] Field of Search ..... 42/1 MH, 16, 18, 50; 89/35 R; 102/38

[56] References Cited

U.S. PATENT DOCUMENTS

| | | | |
|---|---|---|---|
| 2,372,685 | 4/1945 | Schaich | 89/35 R |
| 3,120,070 | 2/1964 | Reed | 42/18 |
| 3,139,799 | 7/1964 | Benson | 42/18 |
| 3,235,995 | 2/1966 | Reed | 42/50 |
| 3,463,136 | 8/1969 | Vadas et al. | 42/1 MH |
| 3,901,153 | 8/1975 | Brabets et al. | 102/38 |

*Primary Examiner*—Charles T. Jordan

*Attorney, Agent, or Firm*—Nathan Edelberg; Harold H. Card, Jr.; Robert O. Richardson

[57] ABSTRACT

In a bolt actuated firearm having a cartridge receiver station communicating linearly with a firing chamber, magnetic means in the receiver station which cooperate with the cartridge magazine or belt to first positively move each cartridge from the magazine or belt into the receiver station and then to releasably hold the cartridge in the station for in line movement into the firing chamber under the influence of the bolt, the magnetic means also guiding axial linear movement of the bolt to its firing chamber position and sequentially thereafter releasably holding the bolt thereby to prevent bounce of the bolt and cartridge until firing of the cartridge.

11 Claims, 6 Drawing Figures

MAGNETIC CARTRIDGE CHAMBERING AND BOLT HOLDING SYSTEM

Government Rights

The invention described herein may be manufactured and/or used by or for the Government for governmental purposes without the payment of any royalty thereon.

BACKGROUND OF THE INVENTION

Heretofore, difficulties have been encountered in in-line feeding of cartridges into the receiver inlets of firearms, particularily of the bolt actuated blowback type, and in positive positioning of the cartridge in the receiver preparatory to in-line introduction thereof into the firing chamber by the bolt carrier. These difficulties were further compounded by the fact that the bolt, in moving to the in battery position to move the cartridge into the firing chamber from the receiver, was not positively controlled in its travel to assure a linear axial movement of the bolt. Thus if the cartridge was not axially aligned with the firing chamber while in the receiver and the traveling bolt was not axially aligned with the firing chamber, a misfire or jamming of the cartridge could occur as a result of improper feed and possible resulting stubbing caused by misalignments.

Furthermore, inherent in completion of the bolt travel to the in battery position is the uncontrolled bounce characteristics of the bolt on impact of the bolt with the receiver or barrel in chambering the cartridge in the firing chamber. Bounce has been recognized as a primary cause of out of battery firing of cartridges, i.e., premature firing or delayed ignition of the cartridge leading to firing out of battery.

Magazines have for years involved in their design complicated configuration requirements for containing rounds and also means to guide, pilot, and ramp rounds into the firing chamber in other than in-line feed.

SUMMARY OF THE INVENTION

With the present invention, these and other problems, difficulties and disadvantages of the prior art are substantially overcome by the provision of a new and unobvious magnetic cartridge chambering and bolt holding system incorporated in the receiver housing 6 of the firearm in a location adjacent the cartridge feed inlet 28 of the receiver 4. The magnetic means 36–42, in cooperation with the magazine feed spring 27, if the firearm is magazine fed, or with the belt if the firearm is belt fed, accelerates introduction, by magnetic attraction, of the cartridge 24 into the feed inlet 28 of the receiver. The magnetic means are so positioned in the receiver housing with respect to both the feed inlet and the firing chamber 32 that the cartridge is not only positively moved into the receiver housing from the feed inlet but is also positively positioned and held in such position for axial linear movement from such position into the firing chamber, under the influence of the magnetic attraction of the magnetic means.

Once the cartridge has been positioned in the receiver housing and is being held stationarily in this position under the influence of the magnetic means, the bolt 8 in its conterrecoil movement fully engages the rear of the cartridge and begins to drive or ram the cartridge toward the firing chamber.

It is noted that, empherically, the coefficient of sliding friction between the magnetic means and the cartridge is substantially less than the holding force of the magnetic field of the magnetic means on the cartridge, so that linear movement may be imparted to the cartridge by the bolt quite readily.

After the bolt has moved the cartridge out of the magnetic field of the magnetic means toward the firing chamber, a portion of the bolt comes into the influence of the magnetic field of the magnetic means and its axial movement to its final in battery position is now under the positive guiding control of the magnetic means to assure linear movement of the bolt into its in battery position. Moreover, when the bolt impacts against the receiver or barrel in reaching its in battery position, the tendency of the bolt to rebound or bounce is substantially reduced, especially so under elevated firing conditions, because the bolt is still under the magnetic influence of the magnetic means.

The magnetic means also positively assist control of axial linear movement of the bolt during a portion of its recoil travel, as well as control of movement of the spent cartridge case on extraction thereof from the firing chamber.

The magnetic force that secures the bolt in the in-line position is overcome after firing by the high energy recoil thrust of the fired ammunition or by the manual charging force applied by the operator.

DESCRIPTION OF THE DRAWING

These and other objects, featured and advantages of the present invention will become readily apparent to one skilled in the art from a reading of the following description of a preferred embodiment, when read in conjunction with the accompanying drawing, wherein like reference numerals and characters refer to like and corresponding parts throughout the several views and wherein.

DESCRIPTION OF A PREFERRED EMBODIMENT

Figure 1:
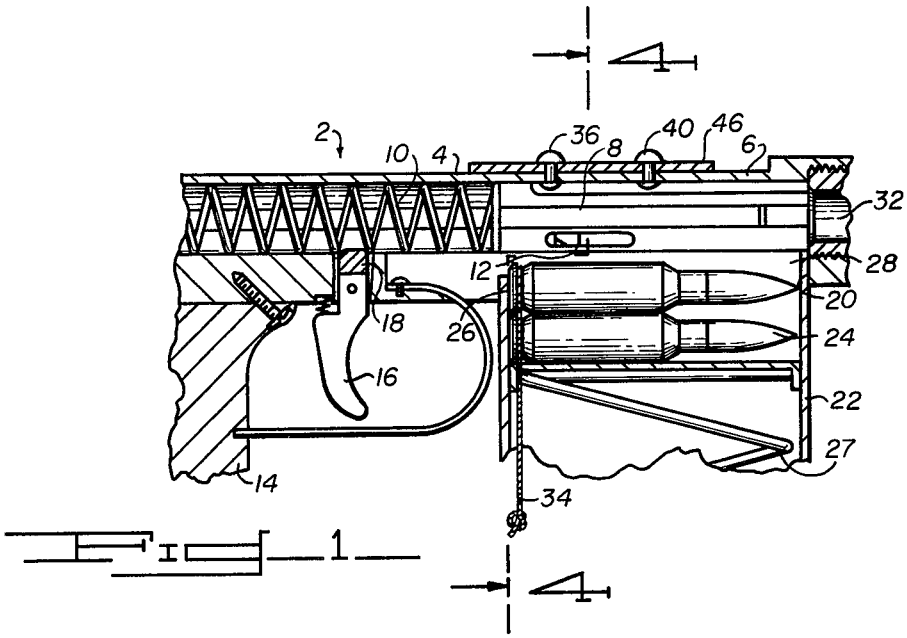
FIG. 1 is a fragmentary side view in section of a magazine fed rifle incorporating features of the present invention illustrating the bolt and a cartridge in the in-battery position.
Figure 2:
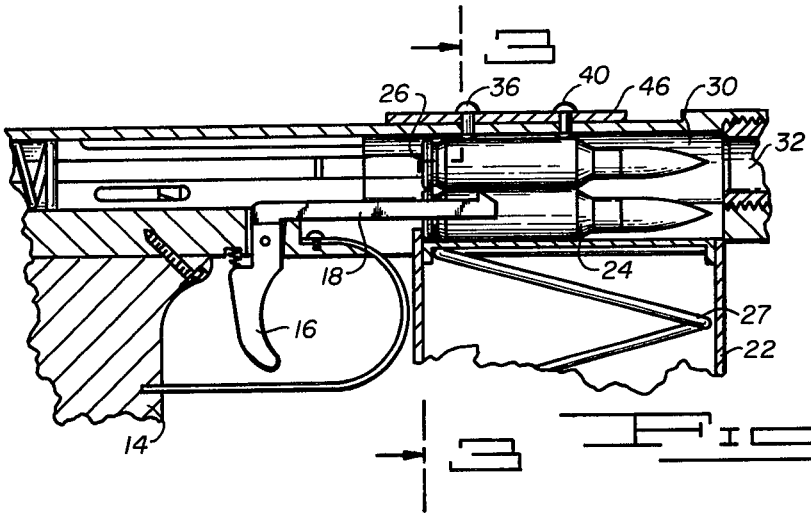
FIG. 2 is similar to FIG. 1 but showing the bolt in the out of battery position.

As shown in the drawing, a magazine fed firearm of the blow back rifle type, generally indicated by the numeral 2, has a receiver 4 defining a receiver housing 6. A bolt 8 is positioned in the rifle for longitudinal linear movement between an in battery position (FIG. 1) and an out of battery position (FIG. 2). The bolt 8 is biased to the in battery position by a compression spring 10 (FIG. 1). A spring biased firing pin 12 of conventional construction is coaxially carried by the bolt.

A pistol grip 14 depends from the receiver 4 rearwardly of a trigger 16 having an integral sear 18 for releasably holding firing pin 12 in a cocked position.

Provided in the bottom of the receiver 4 is a depending and vertically extending magazine well 20 arranged to receive a magazine 22 for holding a plurality of cartridges 24, each of which is provided with a primer 26 in the base thereof. Cartridges 24 are biased upwardly from a magazine 22 by a magazine spring 27 for delivery through a cartridge feed inlet 28 formed in the receiver 4 to a cartridge indexing station or chamber 30 (FIG. 2) in the receiver housing 6.

The magazine is of the lipless type described in my U.S. Pat. No. 3,235,995, and accordingly, the round retaining string 34 shown and described therein is employed to initially retain the cartridges in the magazine 22. When the retaining string 34 is removed, the magazine spring 27 biases the first cartridge through the feed inlet 28 into the indexing chamber 30 for delivery to the firing chamber 32 (FIG. 2).

The structure and operation of the rifle thus far described is conventional in nature and similar to the firearm described and shown in my U.S. Pat. No. 3,120,070.

Figure 3:
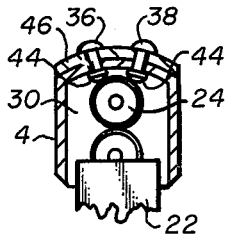
FIG. 3 is a view taken along line 3—3 of FIG. 2.
Figure 4:
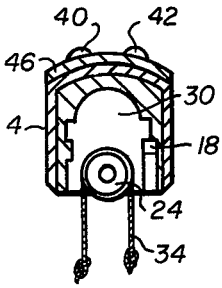
FIG. 4 is a view taken along line 4—4 of FIG. 1.

The cartridge indexing and bolt holding assembly of the present invention comprises magnetic means which in the drawing is depicted as a plurality of magnetic buttons 36–42, four in number. The buttons 36–42 are located in pairs, 36 and 38, and 40 and 42 respectively (FIG. 3). Each button extends from the upper surface of the receiver 4 through the receiver and into the receiver with their inner ends 44 spaced from the interior wall of the receiver in the area of the receiver station or chamber 30.

The buttons 36–42 all pass through and hold to the receiver a shield 46 of non magnetic material located on the exterior surface of the receiver.

In operation, with the bolt 8 in its out of battery position (FIG. 2) the magnetic buttons 36–42 attract the next metal cartridge 24 from the magazine 22 through the feed inlet 28 into the cartridge station or chamber 30 with an assist from the magazine spring 27. It will be noted that the magnetic attraction accelerates the movement of the cartridge into the chamber 30 when compared to the movement of the cartridge when only under the influence of the spring 27.

The cartridge is then positively held by and against the magnetic buttons ready for linear movement into the firing chamber by the bolt.

As the bolt 8 moves into battery position, it contacts cartridge 24 and drives it against the holding force of the magnets 36–42 into the firing chamber 32. As the bolt moves into the station area 30, the attraction of the magnets 36–42 control its movement into the in battery position, where, once in such position, the magnetic attraction minimizes bounce of both cartridge and bolt.

Figure 5:
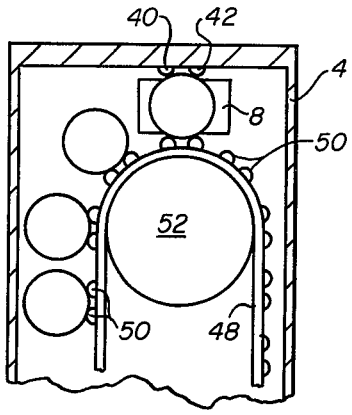
FIG. 5 is a front sectional view through the receiver showing belt feed operation.

The magnetic attraction also assists in positive extraction of the spent casing and in line recoil movement of the bolt. A belt 48 can be substituted for the magazine as shown in FIG. 5. If desired the belt 48 may include a plurality of magnetic cartridge seats 50. The magnetic attraction force of the magnetic means 36–42 in the receiver, of course, would be greater than that of the belt seats 50. The belt 48 is positioned and advanced by a cylindrical drum 52 within the receiver 4. The drum 52 is indexed during recoil of the bolt 8 to position a fresh cartridge in feed position. The cartridge is then attracted by the magnetic buttons 36-42 where it is held ready for linear movement into the chamber by the bolt.

Figure 6:
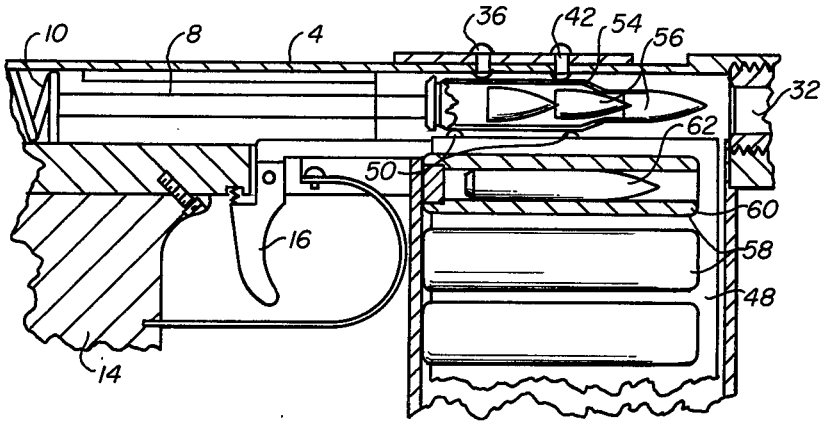
FIG. 6 is a side view in section in which alternate forms of cartridges are used.

As shown in FIG. 6, the present invention is also useable with any type of ammunition having a magnetically attractable surface. This could include ammunition of the telescoped type 54 in which the projectiles 56 are housed in a metal casing and surrounded by propellant. The encapsulated type 58, such as disclosed in U.S. Pat. No. 3,901,153, may also be used. In this type of ammunition the propellant 60 is the casing which surrounds the magnetically attractable projectile 62. It should be understood that even though both types of ammunition are shown on the same belt, in practice this would not be possible. This is due to the drastic difference in the exterior configuration of the cartridges. The weapon chamber would then have to conform to the size and shape of the cartridge to be used.

It is to be understood that, although a preferred embodiment of the present invention has been shown and described herein, the present invention is not limited thereto, because variations and other embodiments will become readily apparent to one skilled in the art from the foregoing description. Accordingly, the present invention should be considered limited only by the scope of the following claims.

I claim:

1. In a firearm assembly having a receiver housing, a reciprocable bolt, a firing chamber in said receiver housing, and an ammunition cartridge feed inlet communicating with said receiver housing for positioning of each cartridge in a guide station in the receiver housing for subsequent linear movement of the cartridge by the bolt into the firing chamber, the improvement comprising:

magnetic means carried by said receiver for magnetically guiding movement of each cartridge through said inlet to said guide station and for holding each of said cartridges in said station for subsequent movement thereof by the bolt into the firing chamber.

2. In the assembly of claim 1 wherein said magnetic means are positioned in the receiver housing to contact and guide the bolt partially into and out of its in battery position.

3. In the assembly of claim 2 wherein the magnetic means comprises a plurality of spaced magnet bars carried by the upper portion of said housing receiver in said interior of the receiver housing.

4. The assembly of claim 3 including a non metallic spacer through which the magnetic bars extend into the housing.

5. The assembly of claim 2 including cartridges of the telescoped or encapsulated type having internal magnetically attractable portions.

6. The assembly of claim 2 wherein the cartridges are in a magazine and fed into the receiver station also under the influence of a spring in the magazine.

7. The assembly of claim 2 wherein the cartridges are belt fed into the feed inlet.

8. The assembly of claim 7 wherein said belt includes a plurality of magnetic seats, one for each cartridge, the magnetic attraction force of the magnetic means being sufficiently greater than that of the belt seats to move the cartridges from the belt through the inlet to said receiver station.

9. In the method of positioning cartridges in a receiver housing of a firearm actuated by a bolt and having a firing chamber, said positioning being for movement by said bolt into said firing chamber, the steps comprising:

attracting each cartridge into the receiver housing magnetically for introduction into the firing chamber, and sequentially actuating said bolt to move the cartridge into the firing chamber.

10. In the method of claim 9 the additional step of locating magnetic means in the receiver housing in position to magnetically guide the bolt partially during its movement in and out of battery.

11. In the method of claim 9 the additional step of positively securing the bolt in its firing position and holding said bolt in said firing position in an anti-bounce position.

* * * * *